United States Patent [19]

Taniguti

[11] Patent Number: 4,611,206

[45] Date of Patent: Sep. 9, 1986

[54] APPARATUS FOR DETECTING QUANTITIES OF ROTARY MEMBER

[75] Inventor: Ryosuke Taniguti, Nagasaki, Japan

[73] Assignee: Mitsubishi Denki Kabushiki Kaisha, Tokyo, Japan

[21] Appl. No.: 418,268

[22] Filed: Sep. 15, 1982

[30] Foreign Application Priority Data

Sep. 25, 1981 [JP] Japan ..... 56-152788

[51] Int. Cl.[4] ..... G08C 19/04

[52] U.S. Cl. ..... 340/870.11; 340/870.07; 340/870.18

[58] Field of Search ..... 340/870.02, 870.18, 340/870.21, 870.32, 870.07, 870.11, 870.12; 322/99; 364/139

[56] References Cited

U.S. PATENT DOCUMENTS

| | | | |
|---|---|---|---|
| 3,030,614 | 4/1962 | Lehan | 340/870.18 |
| 3,303,410 | 2/1964 | Hoover et al. . | |
| 3,467,889 | 9/1969 | Brough-Cunningham | 340/870.18 |
| 3,824,857 | 7/1974 | Smith | 340/870.18 |
| 3,826,868 | 7/1974 | Nugent | 340/870.11 |
| 3,976,981 | 8/1976 | Bowden | 364/139 |
| 4,008,458 | 2/1977 | Wensley | 340/870.02 |
| 4,194,180 | 3/1980 | Noren | 340/870.11 |
| 4,328,494 | 5/1982 | Goodall | 340/870.18 |
| 4,408,204 | 10/1983 | Salvesen | 340/870.02 |
| 4,504,831 | 3/1985 | Jahr | 340/870.11 |

*Primary Examiner*—John W. Caldwell, Sr.
*Assistant Examiner*—Michael F. Heim
*Attorney, Agent, or Firm*—Leydig, Voit & Mayer, Ltd.

[57] ABSTRACT

This invention relates to apparatus for detecting quantities of a rotary member, such as a field system, characterized in that channel identification signals and measurement data after analog-to-digital conversion are combined and then changed into a serial pulse signal by a serializer, that the serial pulse signal is modulated by amplitude modulation and then transmitted to a stationary side, and that on the stationary side, the serial pulse signal is demodulated into a plurality of original analog quantities, which are then indicated, whereby the plurality of quantities of the field system are transmitted by a single transmission system.

2 Claims, 2 Drawing Figures

APPARATUS FOR DETECTING QUANTITIES OF ROTARY MEMBER

BACKGROUND OF THE INVENTION

This invention relates to apparatus for detecting the quantities of a rotary member, which is suited to a system wherein various quantities, for example, the voltage and current of a field magnetic circuit in a brushless A.C. generator are measured without contact.

Prior-art apparatus of this type for application to the brushless A.C. generator has been as shown in FIG. 1. As is well known, the generator is a revolving field type generator. Referring to the figure, letter F denotes the field winding of the generator, numeral 1 a field voltage sensor, numeral 2 a field current sensor, numerals 3 and 4 sense amplifiers, numerals 5 and 6 frequency modulators, numeral 7 a frequency mixer/amplifier, and numeral 8 a transmitting antenna. These components are installed within the rotor of the generator. Numeral 9 designates a receiving antenna, numerals 10 and 11 frequency tuner/amplifiers, numerals 12 and 13 FM demodulators, and numerals 14 and 15 analog indicators.

In operation, the signals of the voltage and current sensors are respectively amplified to required levels by the amplifiers 3 and 4 and then modulated by the frequency modulators 5 and 6. In this case, the transmitting frequencies of the frequency modulators 5 and 6 are unequal. The two frequency-modulated transmission signals are mixed in the mixing transmitter 7, and the mixed signal is transmitted from the transmitting antenna 8. The electric wave is received by the digital receiving antenna 9 on the stationary side. The received signal is distributed by the two tuning receivers 10 and 11, and the distributed signals are demodulated onto the original voltage and current values by the FM demodulators 12 and 13. The voltage and current values are respectively indicated by the indicators 14 and 15.

Since the prior-art measuring apparatus is constructed as described above, the transmission of a plurality of items of data necessitates the individual transmitters and receivers for the respective items of data. This has led to such a disadvantage that the circuit arrangement is complicated to render the apparatus expensive and to render adjusting operations etc. troublesome.

SUMMARY OF THE INVENTION

This invention has been made in order to eliminate the disadvantages of the prior-art apparatus as described above, and has for its object to provide apparatus for detecting quantities of a rotary member, suited to a telemetric system for a brushless A.C. generator, etc., in which the quantities are converted into digital signals on the rotary member side, and the digitized data are changed into serial pulse signals, thereby allowing to dispose a single signal transmission system on the rotary member side, and in which received data are high in reliability.

BRIEF DESCRIPTION OF THE DRAWINGS

FIG. 1 is an explanatory diagram of a prior-art system for measuring the quantities of a field system, while

DESCRIPTION OF THE PREFERRED EMBODIMENT

Figure 1:
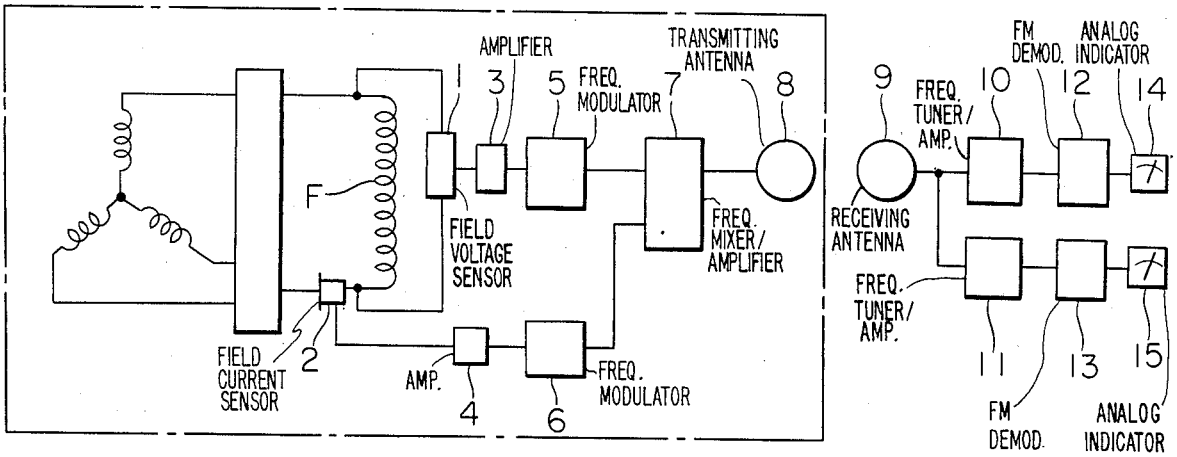
FIG. 1 PRIOR ART
Figure 2:
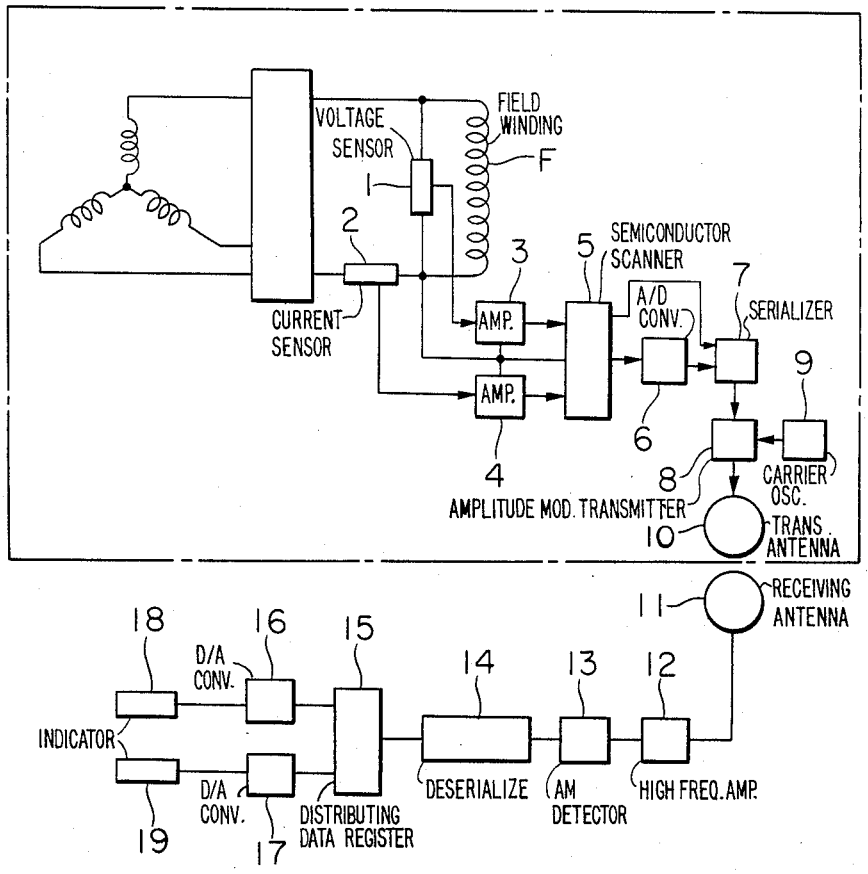
FIG. 2 is an explanatory diagram of a telemetric system for the field system of a brushless A.C. generator in an embodiment of this invention.

An embodiment of this invention will now be described with reference to FIG. 2, concerning a brushless A.C. generator likewise to the case of FIG. 1. In FIG. 2, letter F denotes the field winding of the generator, numeral 1 a voltage sensor, numeral 2 a current sensor, numerals 3 and 4 amplifiers, numeral 5 a semiconductor scanner, numeral 5 an analog-to-digital converter, numeral 7 a serializer, numeral 8 an amplitude-modulation transmitter, numeral 9 a carrier oscillator, and numeral 10 a transmitting antenna. All these components are installed on the rotor side of the generator. The receiving system for converting the received signal into original analog data is stationary. Numeral 11 designates a receiving antenna located on the stationary side, numeral 12 a high-frequency amplifier, numeral 13 an AM detector, numeral 14 a deserializer, numeral 15 a distributing data register, numerals 16 and 17 digital-to-analog converters, and numerals 18 and 19 indicators.

The apparatus operates as explained below. A field voltage and a field current detected by the illustrated sensors 1 and 2 are respectively amplified by the amplifiers 3 and 4 for exclusive use, and channel numbers corresponding to the field voltage and the field current are then produced by the scanner 5. The selected field voltage or field current signals are converted into digital signals by the analog-to-digital converter 6. Along with the channel numbers from the scanner 5, the digital signals are changed into a serial pulse signal by the serializer 7. A carrier produced by the carrier oscillator 9 is modulated by the digital serial pulse signal in the AM modulator 8, and the resulting signal is transmitted from the transmitting antenna 10.

On the stationary side in the receiving system, the electric wave is received by the receiving antenna 11 and then amplified by the tuning modulated-wave amplifier 12. The amplified signal is demodulated into the original digital serial pulse signal by the AM detector 13. Further, this signal is changed into digital parallel data by the digital deserializer 14, whereupon the data are distributed into the original field voltage and field current by the data latch distributor 15 in accordance with the channel data included in the first-mentioned data without regard to the sequence of the field voltage and field current signals within the serial pulse signal. The field voltage and field current are then indicated using indicator circuits comprised of the digital-to-analog converters 16 and 17 to convert the respective distributed digital data into the original analog quantities and indicators 18 and 19 to indicate said original analog quantities.

While, in the above embodiment, the system for measuring the field voltage and the field current has been explained, this invention is also applicable to apparatus for measuring the quantities of a field system or a rotary member in a plurality of channels, the quantities including temperature, stress, oscillation, fuse blowout, insulating resistance etc.

As set forth above, according to this invention, channel identification signals and measured quantities, such as the quantities of the field system of a brushless A.C. generator, can be concurrently transmitted as a serialized digital signal, so that a plurality of items of data can be measured by a single transmission channel and at high precision.

What is claimed is:

1. Apparatus for detecting a plurality of different measured quantities of a rotary member comprising:

circuit means for carrying analog signals representing the different measured quantities over a plurality of different channels, a transmitting system connected with said circuit means including a scanner for sequentially scanning the channels for analog signals, each of the channels being identified with a digital channel identification signal by said scanner, an analog to digital converter for converting the analog signals into digital data signals, a serializer for combining the digital data signals received over the plurality of channels and the digital channel identification signals representing, respectively, the different channels into a single combined signal and changing the combined signal into a serial pulse signal, a modulator for amplitude modulating the serial pulse signal, and an antenna for transmitting the modulated signal and serial pulse signal, said circuit means and said transmitting system being carried by the rotary member, and a stationary receiving system including means for receiving and converting the modulated serial pulse signal from the transmitting system into a plurality of separate indicator signals identified by the channel identification signals without regard to the sequence within the serial pulse signal and representing the different ones of the plurality of measured quantities, said receiving system further having indicators receiving the indicator signals for indicating the different measured quantities.

2. Apparatus for detecting a plurality of measured quantities of a rotor of a brushless AC generator comprising:

a plurality of sensors for respectively sensing said measured quantities, an analog amplifier in series with each sensor and providing a plurality of circuits carrying analog data signals representing measured quantities, said plurality of circuits being connected in parallel, a single transmitting system connected in series with the parallel circuits including a scanner for scanning said parallel circuits for analog data signals, said scanner providing means for associating each of said analog data signals with a digital channel identification signal generated by said scanner, an analog to digital convertor for converting said analog data signals into digital data signals, a data serializer, an amplitude modulation transmitter and an antenna for transmitting modulated signals representing said measured quantities and channel identification signals, said parallel circuits and single transmitting system being carried by said rotor, and a stationary receiving system including, connected in series: a receiving antenna for said modulated signals, an amplitude modulation receivers and a data serializer, and a distributing data latch for receiving and separating said modulated signals according to the channel identification signals, and without regard to the sequence within said modulated signals, into parallel digital signals representing, respectively, different ones of said plurality of measured quantities, and parallel indicator circuits connected to said data latch for receiving said parallel digital signals, each of said indicator circuits having a digital to analog convertor and an indicator in series with each convertor for receiving and converting said digital signals into analog indications of said plurality of measured quantities.

* * * * *